US007913598B2

(12) United States Patent
Granger

(10) Patent No.: US 7,913,598 B2
(45) Date of Patent: Mar. 29, 2011

(54) FORMAT SELECTING DEVICE FOR WIPING MATERIAL DISPENSING ARRANGEMENT

(76) Inventor: Maurice Granger, Saint Priest En Jarez (FR)

( * ) Notice: Subject to any disclaimer, the term of this patent is extended or adjusted under 35 U.S.C. 154(b) by 822 days.

(21) Appl. No.: 10/599,219

(22) PCT Filed: Mar. 15, 2005

(86) PCT No.: PCT/FR2005/050166

§ 371 (c)(1),
(2), (4) Date: Feb. 5, 2007

(87) PCT Pub. No.: WO2005/092166

PCT Pub. Date: Oct. 6, 2005

(65) Prior Publication Data

US 2008/0006648 A1 Jan. 10, 2008

(30) Foreign Application Priority Data

Mar. 23, 2004 (FR) ..... 04 50573

(51) Int. Cl.
*A47K 10/36* (2006.01)
*B26D 7/00* (2006.01)

(52) U.S. Cl. ..... 83/334; 83/337; 83/649; 242/564

(58) Field of Classification Search ..... 225/10, 225/11, 16, 23, 84, 6, 12, 96; 83/648, 649, 83/332, 345, 346, 334, 335; 221/43; 206/389; 242/520–522, 526, 564, 564.1, 564.2, 553
See application file for complete search history.

(56) References Cited

U.S. PATENT DOCUMENTS

| | | | | |
|---|---|---|---|---|
| 3,046,882 | A * | 7/1962 | Aubrey et al. | 101/227 |
| 3,459,353 | A | 8/1969 | Taylor | |
| 6,450,076 | B1 * | 9/2002 | Granger | 83/334 |
| 2001/0045149 | A1 * | 11/2001 | Granger | 83/335 |
| 2004/0188486 | A1 | 9/2004 | Granger | |

FOREIGN PATENT DOCUMENTS

| | | |
|---|---|---|
| FR | 2315894 | 1/1977 |
| FR | 2533124 | 3/1984 |
| FR | 2679887 | 2/1993 |
| FR | 2828084 | 2/2003 |

* cited by examiner

*Primary Examiner* — Phong H. Nguyen
(74) *Attorney, Agent, or Firm* — Heslin Rothenberg Farley & Mesiti P.C.; Victor A. Cardona, Esq.

(57) ABSTRACT

A format selecting device makes it possible to control distribution of material band formats in a one-to-two ratio, wherein the position of the format selecting device enables a cutting blade to come out from a drum at each revolution thereof, for a small format and at each two revolutions per large format. The selecting device acts and initiates a ratio of sprocket assemblies at which sprockets are meshing therebetween for a small format distribution, and certain sprockets are punctually disengaged on the drum revolution for distributing large formats and cancellation of the blade exit outside of the drum. The selecting device is positioned from a flange of a housing and comprises an operating lever provided with two fixed stops which are remote and arranged on the flange defining an angular space corresponding to the lever pivoting in the top or lower part according to a selected format.

11 Claims, 4 Drawing Sheets

Figure 1:
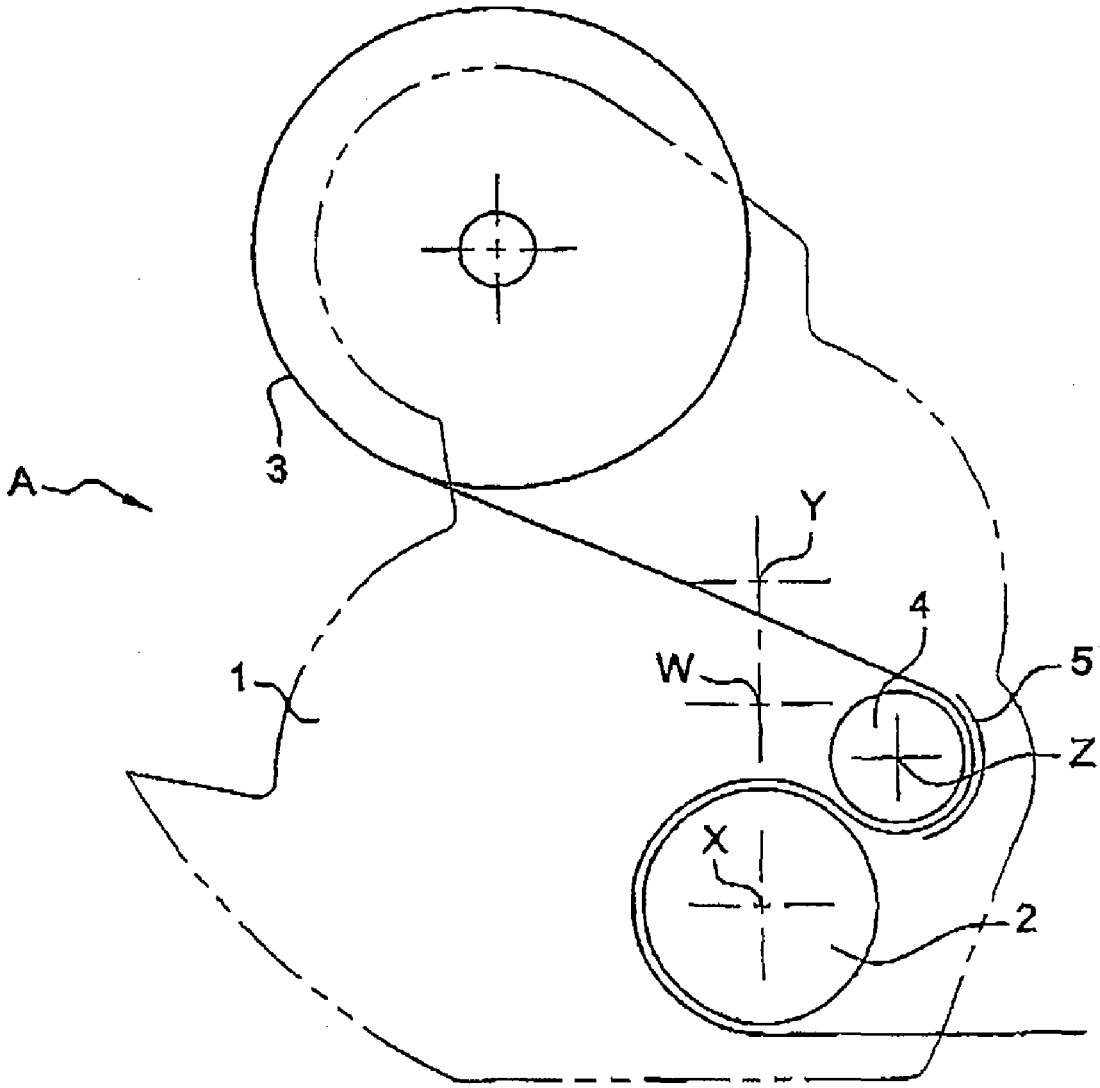

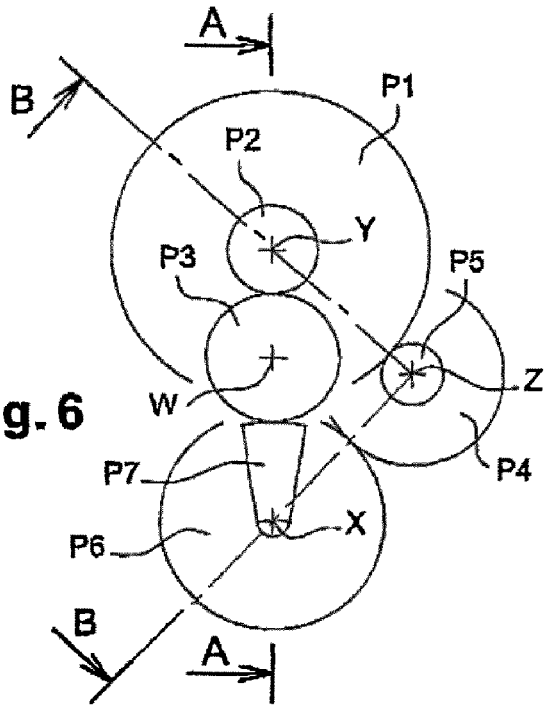
Fig. 6
Fig. 7
A-A
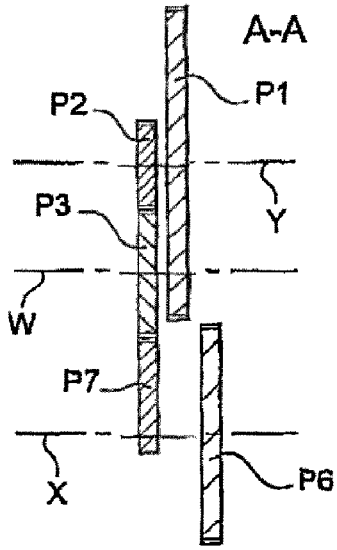
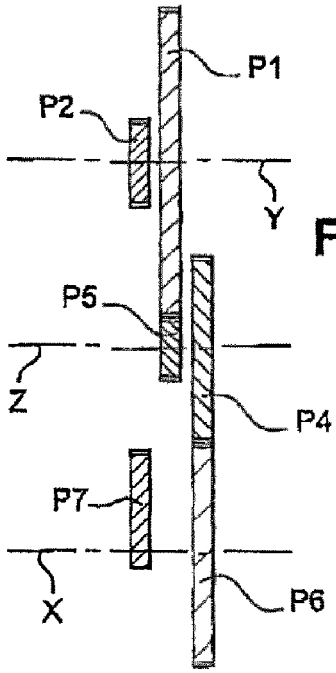
Fig. 8
B-B
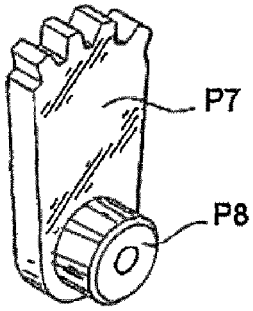
Fig. 9

FORMAT SELECTING DEVICE FOR WIPING MATERIAL DISPENSING ARRANGEMENT

CROSS REFERENCE TO RELATED APPLICATIONS

This application is a 371 filing of International Application PCT/FR2005/050166 filed Mar. 15, 2005, and published, in French, as International Publication No. WO 2005/092166 A1, on Oct. 6, 2005, and claims priority of French Application No. 0450573, filed on Mar. 23, 2004, which applications are hereby incorporated herein, in their entirety.

BACKGROUND ART

The invention relates to the technical sector of automatically cutting appliances for the dispensing of wiping materials of the absorbent-paper type for hand-wipe, toilet-paper, wiping and general cleaning applications.

The applicant has developed numerous appliances of this type which conventionally comprise a housing, a cowl and a drum with an integrated cutting blade, the said blade being capable of emerging from the drum during operation by virtue of means for the triggering and return of the drum. Lateral flanges of the housing are arranged so as to support the reel of material which either comes to bear directly on the drum, according to the teaching of the patent FR 2.322.215, or comes into a plane above the drum without contact with the latter, as, for example, in the embodiment described in the patent FR 2.799.946. In this specific embodiment, a pressing roll is capable of ensuring pressure on the strip of material at a given location in addition to a second pressure zone defined towards the cutting zone of the strip of material in the region of the drum. Thus, the loading reel can be mounted either so as to bear on the drum receiving the cutting mechanism or in a plane above the drum and without contact with the latter. These various types of appliance, in their basic concept and with various arrangements, are in widespread use by the applicant throughout the world through his licensees.

The applicant has thus developed another automatically cutting appliance for the dispensing of wiping material, which is simplified in terms of its implementation and which is the subject of the patent FR No. 2.828.084. Briefly, the appliance comprises a basic housing with a bottom face and a lower face with a lid, the said housing receiving removably, by snapping, a cartridge defining a carrier structure comprising two transverse lateral flanges, a connecting plate arranged between the flanges and a front spacer bar. The flanges, in their upper part, receive connectors supporting the reel of material and, in their lower part, receive two drums arranged side by side, without direct contact between them, the first drum being the blade-carrying drum and the second being the guide drum, the said drums being arranged, at one of their mutually confronting ends, so as to receive toothed rings making it possible to connect them and to rotate them in relation to one another. Moreover, the blade-carrying drum is arranged with a third toothed ring cooperating with the mechanism for triggering the rotation of the drums, including a fixed cam. This blade-carrying arm of the cutting device includes a movable blade which cooperates with the above-mentioned fixed cam, at the same time defining the path of the cutting blade. This specific appliance includes a template for ensuring the setting of the format of the strip of material to be dispensed, either by a previous change of pinion or by the use of a sliding pinion displaceable in order, depending on the position, to cooperate with such and such a gearwheel, in particular by virtue of an arrangement of the drum. The said sliding pinion is associated with a projecting index tongue mounted on the movable shaft supporting the sliding pinion and so as to be displaced previously by the operator. This requires a prior setting of the format by the operator, with the appliance being opened.

The applicant has also worked on devices for selecting the format of the strip of material to be dispensed on other appliances. A proposed solution thus involved opening the drum slightly by the relative spacing apart of its half-parts.

Although, in principle, the idea of an automatically cutting material-dispensing appliance allowing format selection is known, the applicant but also the other companies currently in the market of wiping material dispensing appliances have not succeeded in implementing this type of concept for economic reasons associated with the manufacturing cost of the mechanisms, for reasons of more or less easy practical use and handling and due to a lack of reliability.

Furthermore, the dimensional format ratios proposed in the various research projects conducted hitherto to the applicant's knowledge, both by himself and through what has been published, have been insufficient to maintain and justify an interest in pursuing the said research projects.

In practice, too, each proposed solution was intrinsic to one type of appliance.

BRIEF DESCRIPTION OF THE INVENTION

The applicant's approach has therefore been to reconsider the set problem from the point of view of the solutions proposed previously and to reconsider the arrangement of the wiping-material dispensing appliance without any attention being given to the structure of the appliance in terms of its arrangement with regard to drum and reel, pressing rollers or guide rollers.

The applicant's approach has therefore been to seek a new way of setting up, on any dispensing appliance including a drum and a pressing roller or guide roller, a format selector device which is capable of cooperating with and of being integrated in any type of dispensing appliance.

In other words, the applicant's preoccupation and purpose has been to design a selector device which can be used on different types of dispensing appliance, the reel of material being in bearing contact or in suspension on the drum, and which can be incorporated in structures, such as those described in the patents FR No. 2.332.215, No. 2.799.946, No. 2.828.084 or the like.

Another purpose sought by the applicant has been to design a format selector device which can easily be actuated by the operator simply by the lid of the appliance being opened, this being achieved by means of simple handling with an immediate identification of the format and with a high degree of reliability.

Another sought-after purpose was to propose a format selection of the cut strip of material ranging from single to double.

Another sought-after purpose was to design a selector device which is simple and inexpensive to produce and which can be integrated in all types of dispensing appliance.

Another purpose sought after according to the invention was to have a possibility of easily integrating the format selector device on existing dispensing appliances, without the need for major modifications for these appliances.

These purposes and also others will become apparent from the rest of the description.

According to a first characteristic, the format selector device for wiping-material dispensing appliances, comprising a housing with lateral flanges, between which are arranged a drum receiving a cutting blade, a reel of materials, a pressing roller or a guide roller, is notable in that the format selector device makes it possible to control a dispensing of formats of strips of materials in a ratio of one to two, the position of the format selector device allowing the emergence of the cutting blade from the drum at each revolution of the drum for the small format and every two revolutions of the drum for the large format, the selector device acting and causing a relation between a set of pinions meshing with one another in the small-format dispensing situation, and some pinions being disengaged punctually over a drum revolution in large-format dispensing and cancelling the emergence of the cutting blade from the drum, and in that the selector device is positioned, from one of the flanges of the housing, on the outside and on the inside of the latter.

BRIEF DESCRIPTION OF THE DRAWING FIGURES

Figure 2:
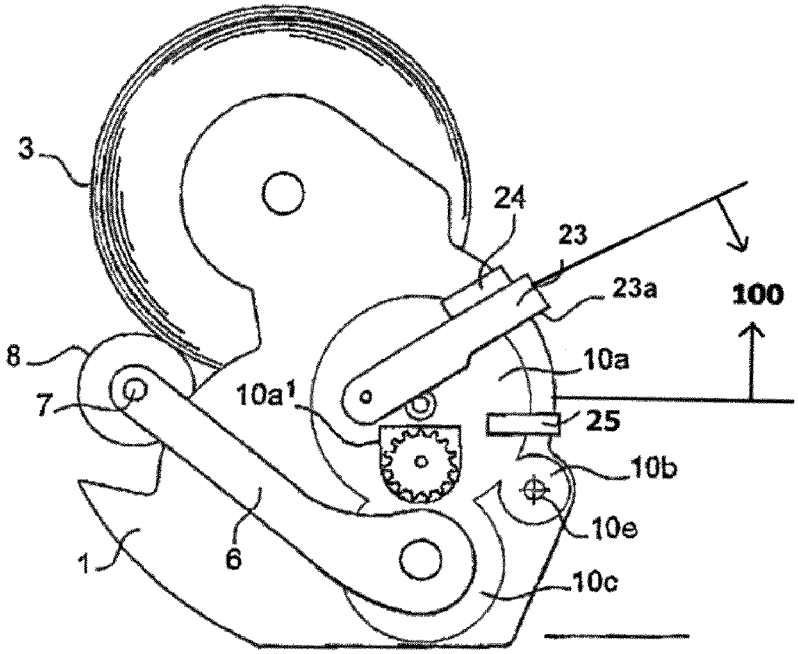
Figure 3:
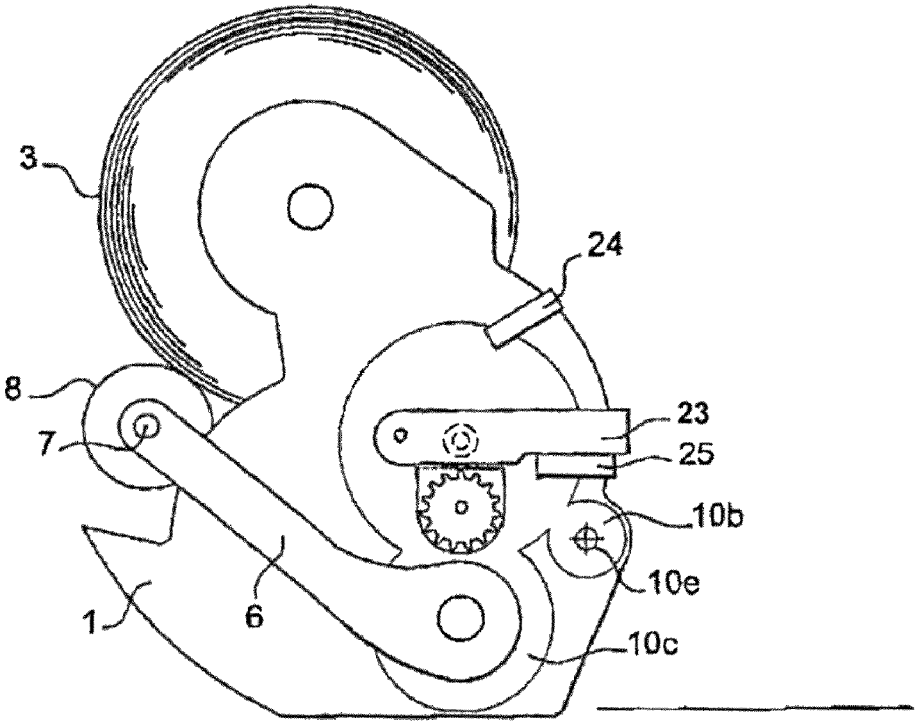
Figure 4:
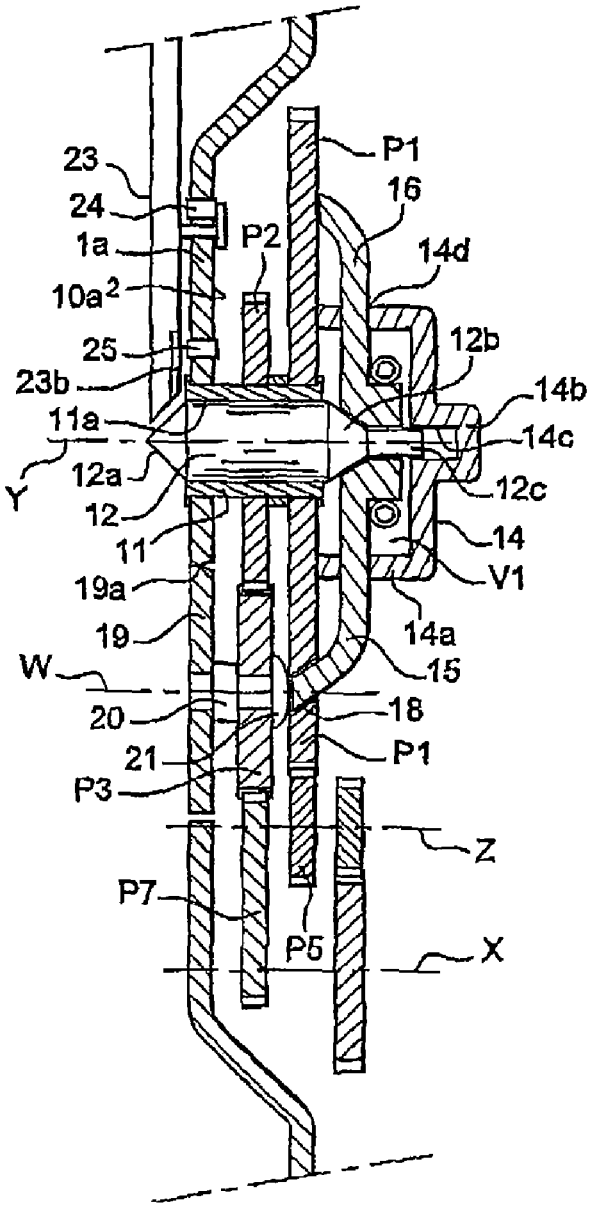
Figure 5:
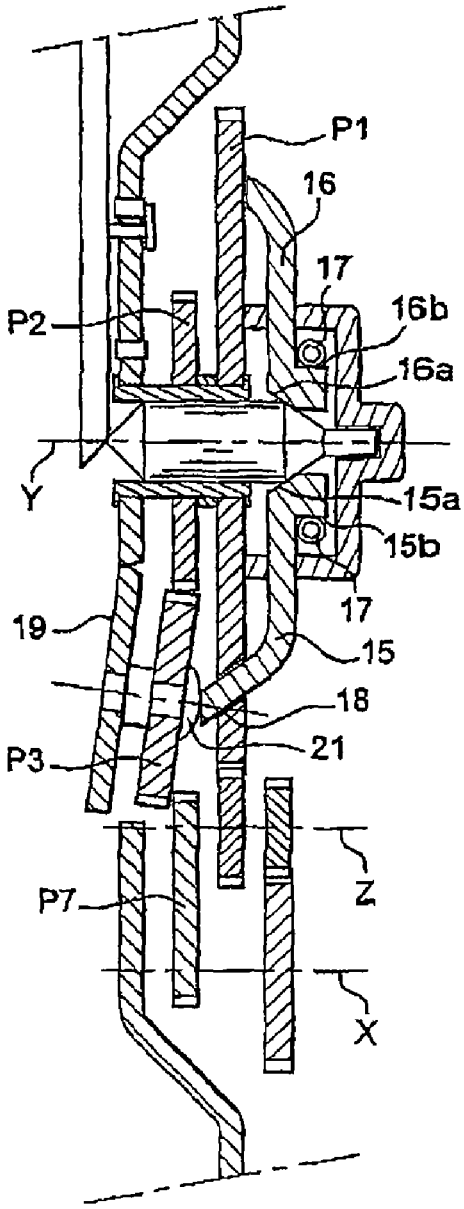

For a clearer understanding, the subject of the invention is illustrated in a non-limiting way in the figures of the drawings where:

FIG. 1 is a diagrammatic side view of a wiper-material dispensing appliance capable of receiving the format selector device according to the invention, FIG. 2 is an outer side view of the wiper-material dispensing appliance, including the selector device according to the invention, the latter being illustrated with the operating lever of the format selector device being in a raised position corresponding to obtaining a first format, FIG. 3 is a view similar to that of FIG. 2, with the said operating lever being in the lowered position for obtaining a second format, in a higher position than the preceding format, FIG. 4 is a large-scale partial sectional view of the housing flange carrying the selector device, the latter being illustrated with the operating lever being in the high position for obtaining the first format, FIG. 5 is a sectional view, according to FIG. 4, after the lowering of the operating lever in order to obtain the second format, FIG. 6 is a diagrammatic side view of a material-dispensing appliance, with an illustration of the axes of rotation X, Y, Z, W of the components of the appliance and of the format selector device, FIGS. 7 and 8 are diagrammatic views illustrating the position of the pinions according to the sections A.A and B.B, FIG. 9 is a view of the pinion (P7) mounted at the end of the drum.

DETAILED DESCRIPTION

In order to make the subject of the invention less abstract, it is now described in a non-limiting way illustrated in the figures of the drawings.

The format selector device according to the invention applies to any type of automatically cutting wiping-material dispensing appliance, whether the reel of material is in bearing contact or in suspension with respect to the drum including the cutting device. The dispensing appliance may itself include other specific arrangements, such as anti-loop systems, safety protection for protective rollers, pressing rollers, guide rollers and the like, which it has been possible to develop, in particular, in the applicant's prior patents. The dispensing appliance comprises a housing with two lateral flanges, between which are arranged the drum and the reel and/or reel carrier, pressing roller, guide roller and the like. To understand the invention, FIG. 1 illustrates, as a reminder, a dispensing appliance (A) with a flange (1), the housing and the protective lid not being illustrated, a drum (2) receiving the cutting mechanism (likewise not illustrated), the reel of material (3), here in suspension, and the pressing roller (4), a retractable flap (5) at the location of the pressing roller for passage for the purpose of introducing the end of the strip of material between the pressing roller and the drum. Thus, FIGS. 2 and 3 illustrate diagrammatically an anti-loop device with an articulated lever (6) arranged outside the flange (1), with, at the upper end, the reception of a shaft (7) carrying washers (8) bearing on the reel of material.

It is appropriate, then, to present and describe the format selector device according to the invention. This device makes it possible, depending on its implementation and positioning, to dispense strips of material in two formats (A1-A2) in a dimensional length ratio of the strips of 1 to 2. In other words, and as an example, if the first format (A1) makes it possible to dispense a strip with a length of 20 cm, the format (A2) makes it possible to dispense the format (A2) equal to 40 cm. These values are merely indicative and may be modified as a function of the dimensional characteristics of the components of the device.

The use of the device of the invention as a function of the selected format is therefore linked to the amplitude of the movement and of the rotation of particular components of the device for causing the emergence of the cutting blade which is located in the drum. Depending on the position of the selector device, the emergence of the cutting blade from the drum will take place after the execution of one revolution or of two revolutions, as will become apparent later after the description of the selector device and of its functioning.

The structure of the device is described below. According to the invention, the latter is arranged on one of the flanges (1) of the housing, both at the outside and on the inside of the latter. The said flange has first of all, on the outside, a projecting shape with three zones (10*a* 10*b* 10*c*) defining internally cavities for receiving the various components of the selector device, but also parts of the drum and of the pressing roller which participate in the functioning of the device. The upper shape (10*a*) is cylindrical, with a window-forming cutout (10*a*1) in the lower part. At its centre, identified by the horizontal axis (Y), is provided fixedly a horizontally arranged hub (11) which is attached to or is directly formed, during moulding, with the bottom face (10*a*2) of the said shape. The said hub (11) protrudes from the flange and internally projects substantially from the latter. The hub (11) has an inner bore (11*a*) allowing the guidance of a pusher member (12) profiled at its ends. The hub (11) receives on its outer periphery, in succession, a second pinion (P2) mounted freely in terms of rotation by means of light mounting or by means of rolling rings. The said second pinion (P2) is located on the axis (Y) thus oriented opposite the bottom face of the said cylindrical shape (10*a*). The said hub (11) also receives, freely rotatably, a first pinion (P1) of a larger diameter which is capable of cooperating and meshing with a fifth pinion (P5) arranged at the end of the axis of the pressing roller, the axis being identified by (Z). The two pinions (P1-P2) mounted on the hub (11) cannot be displaced axially, being retained by collars of the hub. The pinions (P1-P2) are secured to one another in any suitable way and rotate together. The pusher member (12) is profiled at its front end with a conical profile (12*a*), at the same time projecting from the flange of the outer face of the cylindrical shape (10*a*). The pusher member (12) has at the other end (12*b*) a conical profile which is extended by a cylindrical appendage (12*c*). The said appendage (12*c*) is capable of being accommodated, after the axial displacement of the pusher member, in a hole (14*c*) formed on a cylindrical cap (14) having a base (14*a*) integral with the first pinion (P1) by any means, a bottom face (14*b*) receiving the said hole, at the same time defining an inner volume (V1). The pusher member is thus free in terms of translational motion in a limited and controlled manner in a way which will be described later. According to an important arrangement, the said cap (14) has, in the inner volume in question, a transverse recess (14*d*) defining a guide corridor for two slideably mounted cams (15-16). The two cams (15-16) are profiled in a very specific way and are thus arranged on either side of that end of the pusher member which projects into the abovementioned inner volume (V1). On the opposite faces of the pusher member, the cams have an oblique profile (15*a*-16*a*) for cooperating with the conical end part (12*b*) of the pusher member (12). The said cams project externally from the receptacle formed by the cap and, for this purpose, have on their periphery a grooving (15*b*-16*b*) allowing the positioning of an elastic seal (17). According to an important arrangement of the invention, the first pinion (P1) has an oblique window (18) allowing the passage and, in some situations, the projection of one (15) of the cams (15-16) by the amount of the thickness of the said pinion (P1). To ensure this balancing effect of the cams, the cam (16) which is capable of not projecting from the plane of the pinion (P1) is set up with a slight reduction in dimensions. The two cams are held in position by the elastic seal.

According to another arrangement of the device of the invention, the circular shape (10*a*) has, in its lower part, a window-shaped cutout. Around this is arranged a flap (19), the upper part (19*a*) of which is secured to the outer face of the said shape (10*a*) and affords a capacity for elastic deflection. The flap (19) receives a shaft (20) supporting a third pinion (P3) which is capable of meshing with the second pinion (P2) in particular phases. The axis (W) of this third pinion is located between the axes X and Y. The third pinion has, on its inner face, a projecting stop (21), the function of which will be provided later.

Moreover, the flange (1) has a second cylindrical shape (10*b*) with a central orifice (10*e*) allowing the shaft of the pressing roller to be received. The depth of the cavity of this shape (10*b*) is such that, when the shaft of the pressing roller is positioned, the fifth pinion (P5) arranged on the pressing roller is capable of meshing with the said first pinion (P1).

Moreover, the flange (1) has, in its lower part, a third cylindrical shape (10*c*) with an axis (X) corresponding to the axis of the drum receiving the cutting device. The depth of the cavity of this third shape is such that the said drum with a seventh pinion (P7), designed as a toothed quadrant with four teeth, is capable of meshing with the third pinion (P3) in certain circumstances. The drum has, on the supporting shaft of the pinion (P7), a pinion (P8) capable of cooperating with a pinion mounted at the end of the cutting-blade support in order to ensure the emergence of the cutting blade under particular conditions. The outer visible face of the said shape (10*c*) is capable of receiving, for guidance and as a roller, the articulated arm of an anti-loop device.

Lastly, the format selector device comprises an operating lever (23) including two fixed stops (24-25) spaced apart and arranged on the front part of the edge (1*a*) of the flange (1), these stops being attached and directly formed on the flange (1) or on the first shape (10*a*). The angular spacing 100 defines the tilt of the abovementioned operating lever (23). This tilt may take place counter to a tension and return spring making it possible to have a stable position of the said lever. It is expedient to note that the lower edge (23*a*) of the said operating lever is in contact with the front oblique end (12*a*) of the pusher member (12). The lever comprises an oblique ramp (23*b*) opposite the end of the pusher member so as to cooperate with the latter, at the same time covering it, in the phase of the dispensing of material according to the format (A2). When the lever is in the upper position, the pusher member is not stressed. This corresponds to the dispensing of a strip of material of small format, and, when the pusher member is stressed downwards, this corresponds to the implementation of the dispensing of material of large format.

It is therefore appropriate to refer to the mode of functioning of the selector device in the two phases in question of the dispensing of strip of material in a first format. The first pinion (P1) has 48 teeth, the pinion (P4) on the pressing roller has 24 teeth, the pinion (P6) of the drum has 48 teeth, the pinions (P2-P3) have 18 teeth and at all events an identical number of teeth, and the pinion (P5) has 12 teeth.

In the initial phase of the small format A1, the operating lever is raised upwards and has no action on the pusher member. In this phase, the pinion (P5) of the pressing roller meshes with the pinion (P1), the pinion (P2) meshes with the pinion (P3), itself meshing with the pinion (P7) of the drum, whilst the pinion (P6) of the drum meshes with the pinion (P4) of the pressing roller. In this configuration, the pusher member is not stressed, the cams remain in position and the elastic seal for retaining these is neither stressed nor deformed. The end of the cam (15) is located in the plane of the pinion (P1), without projecting. In this configuration, the pulled strip of material is arranged according to the first format (A1), for example 20 cm, and at each revolution of the drum there is the emergence of the cutting blade, the pinion (P7) meshing with the pinion (P3) and causing the emergence of the cutting blade. The downward tilting of the operating lever for the purpose of cutting to the second format (A2) has the result of causing axial displacement of the pusher member. The slanted part on the inner face of the lever will cause the rearward disengagement of the pusher member.

This, as a corollary, causes the cams arranged around the rear conical end of the pusher member to be spaced apart, the cams being pushed radially. The appended end of the pusher member penetrates into its receptacle on the cap. With these cams moving back in the guide track formed in the receiving cap, the elastic seal will be deformed slightly and move away, while at the same time keeping the cams in their receptacle. The free end of one of the cams (15) will, by sliding, emerge from the plane of the pinion (P1) and come into contact with the projecting inner stop formed on the inner face of the pinion (P3). Under the pushing action according to the arrow (F1), the flap supporting the said pinion (P3) will move away substantially sufficiently to disengage the pinion (P3) from the pinion (P2) and from the pinion (P7) so as to cancel the meshing connection. The said flap retracts elastically when there is contact between the end of the cam (15) and the projecting stop formed on the pinion (P3). In practice, in view of the meshing ratios of the pinions (P6, P1, P4) from single to double, it will be understood that the emergence of the blade from the drum will take place only once every two times, thereby making it possible to lengthen the format. Thus, at the start of the cycle of the first revolution of the drum, thus driving the reserve roller pinion, the projecting end of the cam (15) will come to bear on the stop formed on the pinion (P3) and will cause the latter to escape from the two pinions (P2 and P7), the cutting blade not emerging. After the passage of the stop point established by the end of the cam (15), the flap resumes its place and, during the next revolution of the drum, is opposite the stop point formed in FIG. 3. The latter is therefore not stressed, and the pinion (P7) associated with the drum can mesh and cause the emergence of the blade. The desired format (A2) is thus obtained.

The raising of the operating lever frees the pusher member, and, as a result of the relaxation of the elastic seal, the said pusher member resumes its initial position. Operation and format selection are simple to carry out.

The invention was described above in terms of the use of a pressing roller. Without departing from the scope of the invention, and depending on the structure of the appliance, the pinions arranged on the pressing roller may be inserted on other components of the guide-roller type, with the arrangement being made accordingly.

The invention claimed is:

1. A wiping-material dispensing appliance, the appliance comprising:

a housing with lateral flanges, the housing comprising a drum receiving a cutting blade, a reel of materials, a pressing roller or a guide roller arranged between the flanges, a format selector device for controlling a dispensing of formats of strips of materials in a ratio of one to two, the format selector device comprising a small format position and a large format position allowing emergence of the cutting blade from the drum at each revolution of the drum when the device is in the small format position and at every two revolutions of the drum when the device is in the large format position, the selector device acting and causing a relation between a set of pinions meshing with one another in the small-format position, and some pinions of the pinions being disengaged over a drum revolution in the large-format position to avoid emergence of the cutting blade from the drum, and the selector device positioned, on a lateral flange of the housing and comprising an operating lever including two fixed stops spaced apart and arranged on the flange, at the same time defining an angular spacing corresponding to a position of the lever in an upper or lower part, depending on a selected format corresponding to the small format and the large format, and a movement of said operating lever acting to cause an axial push on a pusher member guided on a hub receiving a first pinion and a second pinion of the pinions set up according to an axis Y, and, by function of position of the lever, the pusher member configured to cause connection between the second pinion and a third pinion to cause emergence of the cutting blade at each revolution of the drum and to cause retraction of the third pinion to cause emergence of the cutting blade once every two revolutions of the drum.

2. The appliance according to claim 1, wherein the second pinion cooperates by meshing with said third pinion which is mounted on a retractable flap and according to an axis W, and said first pinion cooperates with a fifth pinion associated with a pressing roller, and a seventh pinion is arranged at the end of the drum receiving the cutting blade and cooperates with the third pinion.

3. The appliance according to claim 2, wherein a hub integral with the flange and projecting internally from the flange is arranged with an inner bore allowing axial guidance of the pusher member and receives rotatably, on its periphery, the first pinion and the second pinion secured to one another, and the pusher member is profiled at its front end with a conical profile capable of cooperating with the operating lever and at an other end with a conical profile extended by an appendage so as to be accommodated in an orifice formed on a guide cap integral with the first pinion.

4. The appliance according to claim 2, wherein the first pinion is arranged so as to receive a guide cap allowing axial displacement of the pusher member and radial displacement of two profiled cams in a inner volume of the cap, forming a guide track, this taking place counter to an elastic retaining and return means, and the first pinion arranged with an oblique window allowing passage and projection of an end of one of the cams so as to come into contact with and push on the third pinion for the purpose of retracting the third pinion.

5. The appliance according to claim 4, wherein the cams are arranged on either side of the other end of the pusher member and have an oblique profile for cooperating with the said other end.

6. The appliance according to claim 2, wherein the flange has on the outside a projecting shape with three zones defining internally cavities for receiving components of the device and drum and pressing roller parts, a first zone of said zones receiving the hub and pusher member and having in its lower part a window-forming cutout for receiving an elastically retractable flap carrying a supporting shaft of the third pinion.

7. The appliance according to claim 4, wherein the third pinion is arranged on its inside with a projecting stop cooperating with amend of a first cam of said two profiled cams when the said first cam is stressed in terms of radial displacement under action of the pusher member stressed by the operating lever.

8. The appliance according to claim 6, wherein the flange has a second cylindrical zone of said projecting shape having a central orifice allowing a shaft of the pressing roller to be received, a depth of a cavity of this second zone being such that the fifth pinion positioned on the pressing roller is capable of meshing with the first pinion.

9. The appliance according to claim 6, wherein the flange has a third cylindrical zone of said projecting shape with an axis X corresponding to an axis of the drum receiving the cutting device, a depth of a cavity of the third zone being such that a seventh pinion arranged on the drum and comprising a toothed quadrant with four teeth is capable of meshing with the third pinion.

10. The appliance according to claim 9, wherein the drum has, on a supporting shaft of the seventh pinion, an eighth pinion cooperating with a pinion mounted at an end of the cutting-blade support in order to ensure the emergence of the blade.

11. The appliance according to claim 9, wherein the drum has a sixth pinion capable of meshing with a fourth pinion set up on the pressing roller.

* * * * *

UNITED STATES PATENT AND TRADEMARK OFFICE

CERTIFICATE OF CORRECTION

PATENT NO. : 7,913,598 B2
APPLICATION NO. : 10/599219
DATED : March 29, 2011
INVENTOR(S) : Maurice Granger It is certified that error appears in the above-identified patent and that said Letters Patent is hereby corrected as shown below:

Claim 7, at Column 8, Line 31: Delete "with amend" and insert -- with an end --

Signed and Sealed this
Seventeenth Day of May, 2011

David J. Kappos

David J. Kappos
*Director of the United States Patent and Trademark Office*